United States Patent [19]

Lipson

[11] Patent Number: 4,898,474

[45] Date of Patent: Feb. 6, 1990

[54] SELF-CONTAINED, ADJUSTABLE DISPERSER AND MIXER

[76] Inventor: Benjamin Lipson, Apt B 403, Cedarbrook Hill Apts., Wyncote, Pa. 19095

[21] Appl. No.: 110,840

[22] Filed: Oct. 21, 1987

[51] Int. Cl.[4] ..... B01F 7/18; B01F 15/00

[52] U.S. Cl. ..... 366/286; 366/199; 366/207; 366/289; 366/331; 92/110

[58] Field of Search ..... 366/65, 98, 61, 199, 366/159, 285, 174, 286, 207, 289, 331, 347, 349; 92/110, 111; 91/4 R

[56] References Cited

U.S. PATENT DOCUMENTS

| | | | |
|---|---|---|---|
| 1,495,949 | 5/1924 | Carroll | 92/110 |
| 2,908,482 | 10/1959 | Curtis et al. | 92/110 |
| 3,356,350 | 12/1967 | Burr et al. | 366/285 |

FOREIGN PATENT DOCUMENTS

| | | | |
|---|---|---|---|
| 136864 | 2/1901 | Fed. Rep. of Germany | 366/286 |

*Primary Examiner*—Timothy F. Simone
*Attorney, Agent, or Firm*—Donald D. Joye

[57] ABSTRACT

A mixing device for liquids is described, wherein improved control of the mix is achieved by restructuring the components so that the character of the mix can be observed easily and corrections effected simultaneously. The disperser/mixer incorporates a moveable and rotatable support structure attached to a piston-in-cylinder arrangement. Hydraulic pressure, pneumatic pressure, or a combination thereof in the cylinder is controlled from a unit on the support structure, rather than the base, through a modified piston fixed to the support structure and containing a passageway for hydraulic fluid, rather than through the cylinder.

2 Claims, 3 Drawing Sheets

SELF-CONTAINED, ADJUSTABLE DISPERSER AND MIXER

FIELD OF THE INVENTION

This invention relates to the field of mixing devices or dispersers for liquid systems, especially those systems in which solids and liquids are being mixed together with liquid being the continuous phase. More particularly this invention relates to mixing devices using a rotating impeller to achieve the mixing or blending. Still more particularly, this invention relates to a means for controlling the mixing operation such that a properly mixed product, for example paint, can be achieved more efficiently.

DESCRIPTION OF THE PRIOR ART

Mixing devices using rotating impellers are well-known and used widely in the paint industry, foodstuffs industry, rubber, plastics and chemical industries, and others. Several manufacturers, for example Shar, Inc., and Hockmeyer supply the industries that have such mixing needs.

Typical arrangement of elements is that shown, for example, by Lodge (U.S. Pat. No. 3,326,532), wherein a vertical impeller shaft with submersible impeller at the lower end is rotated by a motor at the other. The motor is mounted on a horizontal platform or other support structure such as a plate or beam. This support structure is moveable through a piston-in-cylinder arrangement, so that the structure can be moved both vertically and horizontally, that is the structure can be rotated about the cylinder. Motion of this support structure is controlled by hydraulic or pneumatic pressure entering the cylinder through a side connection at the base of the unit, where the control apparatus is located.

The operation of the unit follows typical hydraulic practice. Fluid is pumped into the cylinder under pressure until the weight of the support structure and equipment on it is supported by the fluid. When additional fluid is pumped in under pressure, the piston (and the support structure connected to it) rises; when fluid is allowed to escape, through some valve means for example, the piston sinks. By controlling the pressure, the level of the support structure, and hence the impeller height in the mix, can be adjusted. Changing the impeller height changes the intensity of mixing and thereby affects the mixing efficiency. Alternative means of moving the piston, for example pneumatic (air) pressure or a combination of pneumatic/hydraulic are within the state of the art. For example, air pressure from a compressor may be used to pressurize hydraulic oil in a tank or in a line by appropriate connective fitting, thereby supplying pressure to the hydraulic oil.

Various improvements and adaptations of these devices are constantly being made. Reference is made to the adaptation of Hay (U.S. Pat. No. 4,647,213), wherein a rotating impeller mixing device is adapted to mix radioactive waste and an encapsulant.

In the paint industry, by way of example, solvent or water, pigments, vehicle (generally an organic polymer), surfactants and other chemical additives are fed to a mix tank of the type described above. Condition of the mix in this application is critical, because the mixture is the product. Therefore, control of the mix, generally through viscosity observation, is critical for the paint manufacturer. For example, final mix viscosity for a latex paint might be 115–120 KU (Krebs units) in accordance with the method of viscosity measurement used by the industry in this example. If the viscosity is out of specification, other ingredients are added according to the practices of the art. The mixing intensity is adjusted by moving the height of the impeller. A trained operator will know if the mix is progressing correctly by visual observation and viscosity checks. However, the impeller height can only be adjusted from a remote location. Thus, the operator must leave the position of visual observation and move to a relatively remote location to adjust the lift control for the support structure. It cannot be determined that the correct adjustment has been made until the operator returns to visually observe and test the mix. Therefore, it is easy to over or under adjust the impeller height and ruin the batch through incorrect mixing. As a consequence, new material must be added and the operation continued until the viscosity specification is met. This wastes valuable production time and represents a serious inefficiency in the mixing operation.

Therefore, it would be desirable to find a means whereby the operator can visually inspect the mix and simultaneously control or adjust the impeller speed and height. State of the art machines are not so adapted because of the disposition and arrangement of the lift control apparatus.

Thus, an object of this invention is to provide a means whereby liquid mixtures undergoing mixing or dispersing operations in the type of equipment described can be visually inspected and controlled simultaneously, without the need for an operator to move to a remote location. Another object of this invention is to provide a means for lift control to eliminate the necessity for an operator to move to a remote location to adjust the impeller height and speed.

SUMMARY OF THE INVENTION

The invention is a disperser or mixing device for materials in which liquid is the continuous phase comprising (a) a motor connected to a shaft at one end having an impeller at the other end to do the mixing, (b) a movable support structure to which the motor is attached, (c) a piston-in-cylinder support shaft in which the piston is attached to the support structure, (d) a base on which the cylinder of the support shaft rests, and (e) a control means to move the piston relative to the cylinder and thereby raise and lower and rotate the support structure, wherein the control means is selected from the group consisting of hydraulic control, pneumatic control, or a combination of the two, and wherein the control means has actuating means fixed to the support structure to be in easy reach of an operator to adjust or control the height or speed of the impeller, simultaneously keeping the mix in view.

The present invention may also be described as an improvement over the art, in that it provides a way for better control of the mixing process, wherein the improvement comprises placing the actuating means in ready reach of an operator by means of a post or button board attached to the support structure (so that the mix can be kept in view simultaneously with adjusting the control unit), and by providing the piston with openings in both ends for the passage of hydraulic fluid through it, rather than the cylinder, for control of the impeller height.

In one specific embodiment of the present invention, the piston is a solid body provided with an oil galley or passageway to allow fluid, generally an oil or hydraulic fluid or air, to pass through the piston from top to bottom when pressurizing the cylinder, and from bottom to top when fluid is allowed to escape from the cylinder. This is different than present practice where the fluid enters through a hole in the cylinder, and the piston is a solid rod or a hollow, closed-ended tube. Alternatively, in a preferred embodiment of the present invention, the piston may comprise a hollow, closed-ended tube with a hole at each end (top and bottom) to allow passage of fluid therethrough.

Pressure from the control unit acts to cause motion of the piston axially in the cylinder according to well-known hydraulic principles. The axial motion of the piston gives rise to vertical motion of the support structure and hence the impeller, and thereby satisfies the requirements of a mixing device in the art. The piston may be fit with another device to cause it to rotate in the shaft by hydraulic pressure. This device is used in the art to effect rotation of the support structure.

DETAILED DESCRIPTION OF THE PREFERRED EMBODIMENTS

Figure 1:
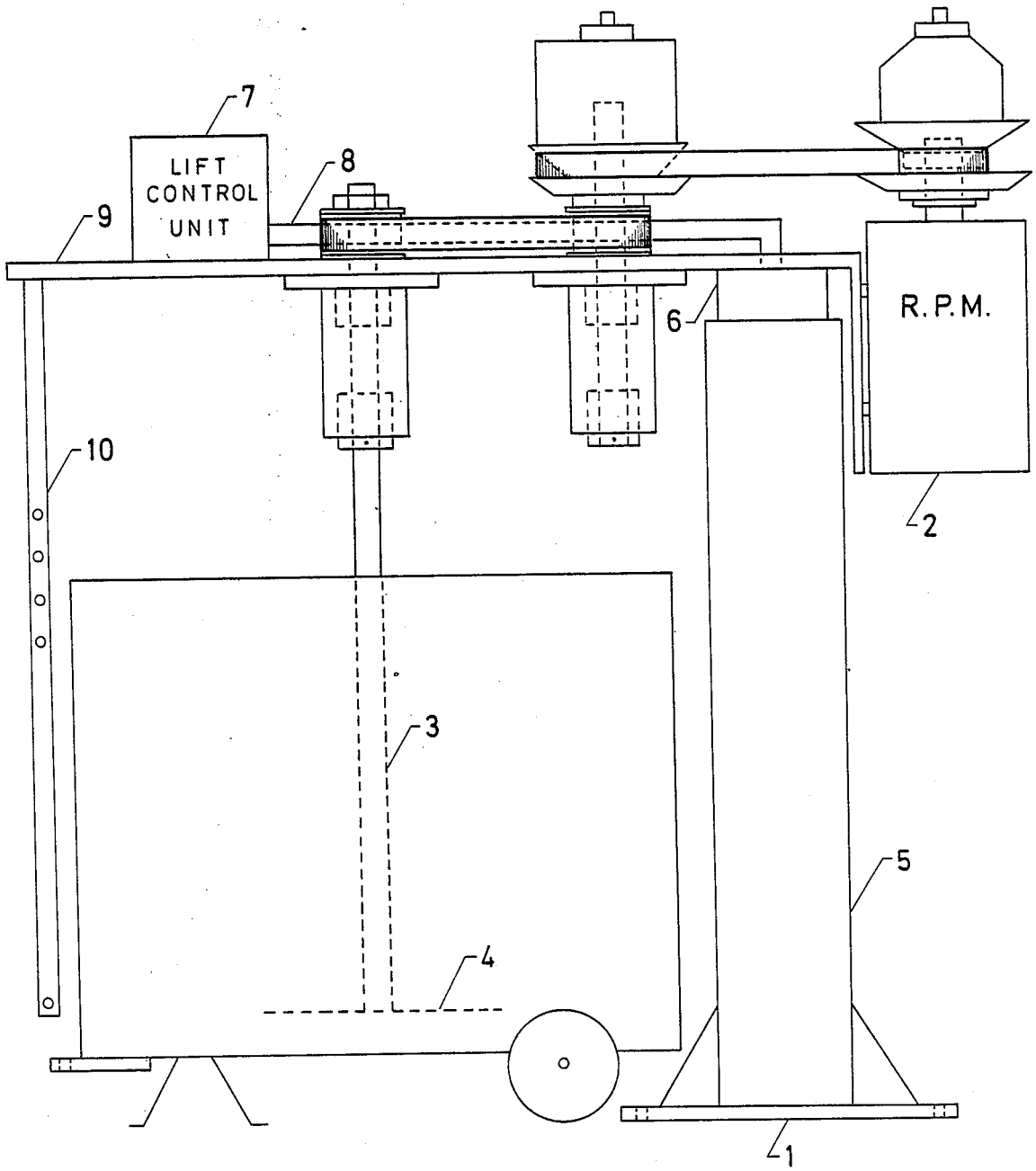
FIG. 1 illustrates the components of a mixing apparatus for liquids according to the present invention.

FIG. 1 shows the elements of the mixing device according to the present invention. Cylinder 5 is fixed rigidly on base 1 and contains piston 6. Mixing is done by means of a motor 2, driving impeller shaft 3 and impeller 4. The impeller 4 is immersed in a separate tank containing liquid to do the mixing. Connecting line 8 carries fluid between control unit 7 and piston 6. Control unit 7 rests on support structure 9 along with the impeller motor. The piston 6 is rigidly attached to the support structure 9 so that all the weight of the support structure and attachments is carried by the piston. Button board or button post 10 for actuating the control unit is placed in a location so that the operator can effect control of the mix, while simultaneously viewing the liquid. For example, the button board may be placed on the support structure with sufficient length to allow the operator to reach the controls when the unit is at its extreme height.

The control function of the mixing device of the present invention may be hydraulically (liquid) or pneumatically (gas) operated, or may be operated by a combination of the two, as is occasionally found in the art. Connections of supply and return lines for the fluid control, check valve placement, and the like are all within the skill of the art and need not be described in detail here. The novel features of the present invention are the placement of the lift control unit on the support structure in such a way to enable the operator to adjust the impeller speed and height without moving to a remote location, for example, by means of a post or button board mounted to the support structure, so that the mix can be kept in full view, and the detail of the piston to enable fluid to move through the piston to effect motion of the support structure and impeller.

Figure 2:
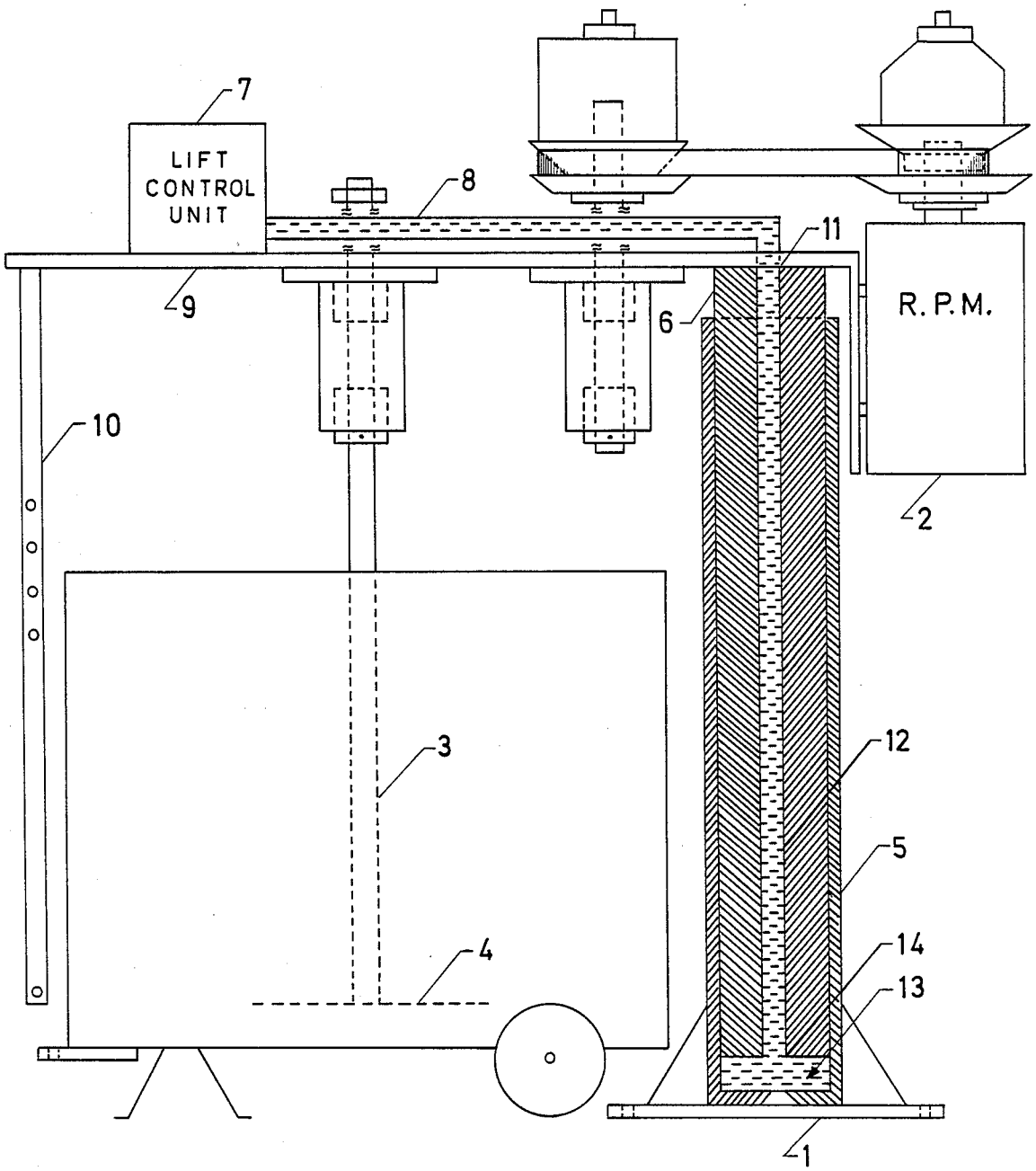
FIG. 2 illustrates the details of the novel piston-in-cylinder arrangement to allow operation and control from the support structure in such a way that an operator can adjust the control unit and remain in full view of the mix.

FIG. 2 shows the essential detail of piston 6 which contains a passageway or oil galley 12 with entrance 11 and exit 14 to permit the passage of fluid (liquid or gas) therethrough, so that piston 6 can move axially in cylinder 5. Fluid control is by control unit 7 fixed on support structure 9. Fluid under pressure enters at and exits at 14 into cavity 13. When pressure is sufficient the support structure will float on the fluid. Pressure in the fluid cavity will then equal the total weight of support structure and its fixtures divided by the piston cross-sectional area, according to well-known laws of hydraulics. Pumping more fluid under pressure into cavity 13 will raise the piston by displacement. Allowing fluid to escape cavity 13 (by means of valves common in the art) will lower the piston. Thus axial motion of the piston can be achieved, thereby raising and lowering the impeller. The support structure may be rotated by including a hydraulically operated rotating collar (not shown) on the piston, as is common in the art. Also common in the art is the use of sealing means to prevent leaks between cylinder and piston. Seals of choice, bearings, etc. can be incorporated into the present invention as desired. By keeping pressure on the piston, a certain impeller height selected by the operator can be maintained, and the mixing operation carried out at this level, or adjusted as desired.

The passageway or oil galley is a central feature of the present invention. This allows control from the top (through the piston) rather than the bottom (through the cylinder) as presently practiced, and also allows mounting of the control unit on the support structure. An alternative to the present invention is to use a hollow cylinder closed at the ends for the piston. Each end has a hole in it, so that fluid can move through, into or out of, the cavity.

Figure 3:
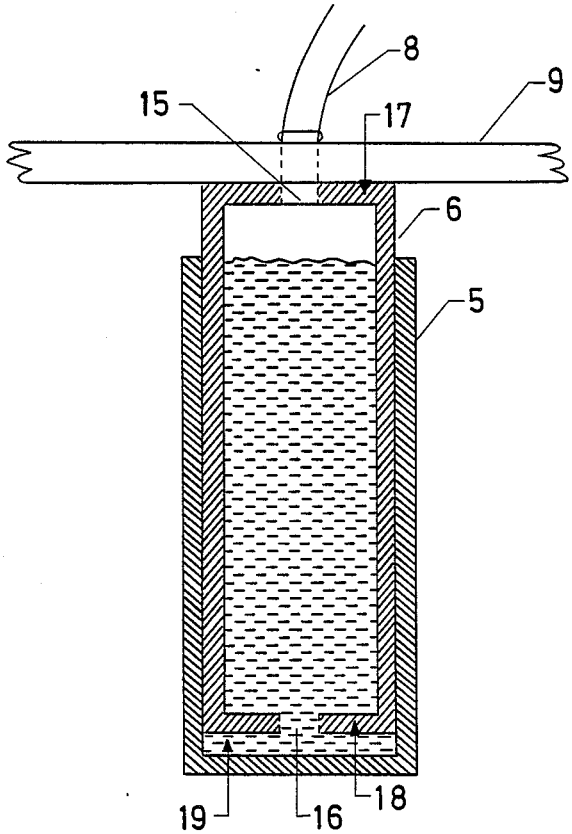
FIG. 3 shows the detail of a preferred piston-in-cylinder arrangement.

FIG. 3 shows an especially preferred embodiment where piston 6 attached to support structure 9 is a hollow tube closed at both ends (17 and 18) except for holes 4 and 5. The piston is essentially filled with hydraulic oil 16 when the piston is resting at the bottom of cylinder 5. Air pressure line 8 is attached to the upper hole in the piston. In this embodiment the piston acts as its own oil reservoir, and air pressure controls the motion of the piston. This eliminates the need for an oil pump or air tank/external oil reservoir, and can be easily and economically implemented.

The above-described features of the present invention are illustrative. Other embodiments may be visualized by those skilled in the art, once this invention is known to them. These embodiments may be within the scope and spirit of the present invention as defined in the appended claims.

I claim:

1. A mixing device for agitating and mixing a liquid, said device comprising,
   (a) a motor connecting a shaft and an impeller to do the mixing,
   (b) a support structure to which the motor is attached,
   (c) a cylinder attached to a base and containing a slidably and rotatably movable piston attached to said support structure,
   (d) a control unit with actuating means to operate said piston in said cylinder by means of a control fluid to raise and lower said support structure,
   wherein said control unit is mounted on said support structure and said control unit actuating means is connected to said support structure to be in easy reach of an operator, such that the operator may operate said actuating means while simultaneously keeping in view said liquid being mixed, and wherein said piston is a solid body containing a passageway for transfer of control fluid through said piston from an entrance at the top of said piston to an exit at the bottom of said piston, to allow said fluid to move between said piston and said cylinder through said passageway.

2. A mixing device for agitating and mixing a liquid, said device comprising, (a) a motor connecting a shaft and an impeller to do the mixing, (b) a support structure to which the motor is attached, (c) a cylinder attached to a base and containing a slidably and rotatably movable piston, one top end attached to said support structure, and the other bottom end resting in said cylinder, (d) a control unit with actuating means to operate said piston in said cylinder by means of a control fluid to raise and lower said support structure, wherein said piston is a hollow tube open at both ends to allow passage of fluid therethrough, in which said piston acts as a reservoir for hydraulic oil, and wherein said piston in said cylinder is moved by means of pneumatic pressure acting at the top end of said piston, and wherein said actuating means is fixed to said support structure within reach such that an operator can operate said actuating means while simultaneously keeping said liquid being mixed in view.

* * * * *